United States Patent [19]

Takagi et al.

[11] 4,420,335

[45] Dec. 13, 1983

[54] MATERIALS FOR ROLLS

[75] Inventors: Tomio Takagi, Osaka; Jitsuhiko Ueda, Kobe; Tadaomi Fujii, Nara; Kazuhiko Tanaka, Osaka, all of Japan

[73] Assignee: Hitachi Shipbuilding & Engineering Company Limited, Osaka, Japan

[21] Appl. No.: 337,472

[22] Filed: Jan. 6, 1982

[30] Foreign Application Priority Data

Feb. 5, 1981 [JP] Japan ..... 56-16513

[51] Int. Cl.[3] ..... C22C 38/06

[52] U.S. Cl. ..... 75/124

[58] Field of Search ..... 75/124 C

[56] References Cited

U.S. PATENT DOCUMENTS 3,963,532 6/1976 Demo, Jr. ..... 75/124 C

FOREIGN PATENT DOCUMENTS 346571 7/1960 Switzerland ..... 75/124 C

*Primary Examiner*—W. Stallard

*Attorney, Agent, or Firm*—Joseph W. Farley

[57] ABSTRACT

A roll material comprising, in proportions by weight, 0.04–0.20% C, 0.2–0.8% Si, 0.4–1.5% Mn, 0.2–1.0% Ni, 10.0–14.0% Cr, 0.5–4% Cu, 0.1–0.5% V, 0.01–0.35% Nb, 0.01–0.06% Al, P and S each in a reduced amount of up to 0.03% as impurity elements, and the balance Fe. The material is comparable in resistance to high-temperature oxidation in 13Cr martensitic stainless steels which are presently used and yet has outstanding strength at high temperatures.

12 Claims, No Drawings

MATERIALS FOR ROLLS

The present invention relates to materials for rolls, and more particularly to roll materials for use in continuous casting equipment.

In recent years, continuous casting equipment has a tendency toward a larger scale and higher speed and operating temperature. The rolls for use in this equipment are subjected to ever stringent ambient conditions. Conventionally low-alloy steels (1Cr-½Mo steel, Ni-Cr-Mo-V steel) have been used most extensively as roll materials useful for continuous casting equipment. As the ambient conditions (especially roll temperature) become severer, the rolls made of such material tend to wear away and develop thermal fatigue cracks more markedly. The high-temperature oxidation due to the rise of the surface temperature of the roll is the predominant cause of wear or abrasion. At present, therefore, martensitic stainless steels of the 13Cr or 13Cr-4Ni type which are resistant to high-temperature oxidation and to corrosion are in relatively wide use. However, such materials are almost equivalent to low-alloy steels and are not always as high as is desired in strength at high temperatures, so that they still remain to be improved in resistance to thermal fatigue cracking, flexural strength, etc. for use as rolls. Thermal fatigue cracks occur when the roll surface is repeatedly subjected to the combination of thermal stress and mechanical bending stress due to contact with slabs. Materials have high resistance to thermal fatigue cracks when high in yield point (0.2% proof stress), great in reduction of area and small in Young's modulus and thermal expansion coefficient. On the other hand, the flexure of the roll appears attributable to the thermal stress and mechanical bending stress that occur when the roll is heated to a high temperature in its entirety during an abnormal operation, followed by cooling. Materials have high flexural strength when having a high yield point (0.2% proof stress) at high temperatures.

Thus the roll materials for continuous casting equipment must have (1) abrasion resistance (resistance to high-temperature oxidation), (2) resistance to thermal fatigue cracking and (3) flexural strength. It is further required that they have brittle fracture resistance.

The object of the present invention is to provide roll materials which have high strength at high temperatures and which nevertheless are comparable in abrasion resistance to the materials (13Cr steel and 13Cr-4Ni steel) presently used.

To fulfill this object, the present invention provides a roll material comprising, in proportions by weight, 0.04–0.20% C, 0.2–0.8% Si, 0.4–1.5% Mn, 0.2–1.0% Ni, 10.0–14.0% Cr, 0.5–4% Cu, 0.1–0.5% V, 0.01–0.35% Nb, 0.01–0.06% Al, P and S each in a reduced amount of up to 0.03% as impurity elements, and the balance Fe.

The roll material of the above composition has abrasion resistance as high as that of 13Cr steel and 13Cr-4Ni steel which are conventionally used, and yet is outstanding in strength at high temperatures (resistance to thermal fatigue cracks, flexural strength, etc.) and also in weldability. The outstanding weldability is very important for the material for the following reason. Even when having high resistance to thermal fatigue, roll materials for continuous casting equipment invariably develop thermal fatigue cracks during a long period of use, so that the cracking portion must be repaired for reuse by removing the portion by grinding or machining and band arc overlay welding.

Under some continuous casting conditions, there arises the need to use a roll material having still higher strength at high temperatures than the above roll material. To meet this need, the present invention provides as a second embodiment a roll material comprising, in proportions by weight, 0.04–0.20% C, 0.2–0.8% Si, 0.4–1.5% Mn, 0.2–1.0% Ni, 10.0–14.0% Cr, 0.5–4% Cu, 0.1–0.5% V, 0.1–0.35% Nb, 0.01–0.06% Al, 0.2–1.2% Mo, up to 0.05% B, P and S each in a reduced amount of up to 0.03% as impurity elements, and the balance Fe.

According to the second embodiment, Mo and B are further incorporated into the roll material of the first embodiment to thereby give the roll material enhanced strength at high temperatures. Of these two elements, Mo especially contributes to the improvement of strength but acts to reduce the weldability, so that the second embodiment is not always superior to the first. Thus one of the two materials should be suitably selected according to the continuous casting conditions and roll inspection period concerned.

When the roll materials of the first and second embodiments have further incorporated therein 0.01–0.2% by weight Ti or 0.01–0.1% by weight Zr, the materials have remarkably improved resistance to high-temperature oxidation, i.e. to abrasion.

The components of the roll materials of this invention and the numerical values specified therefor will be described below in detail together with the reasons therefor. In the following description, the percentages are all by weight unless otherwise specified.

C: C forms carbides when combined with elements, such as Mo (for the second embodiment only), V and Nb, described below, giving increased strength. At least 0.04% of C must be used. However, when the amount of C exceeds 0.20%, the resulting material will have greatly reduced ductility, toughness and weldability.

Si: Si serves as a deoxidizer. It is used not as an alloy element but rather as an essential element of the steel material. To assure a sufficient deoxidizing effect, at least 0.2% of Si needs to be used, but when the amount of Si exceeds 0.8%, delta ferrite tends to separate out in the hardened structure to result in reduced strength, further impairing the hot workability of the material. Thus the Si content is limited to the range of 0.2–0.8%.

Mn: Mn forms austenite. To provide a uniform martensitic structure on hardening and give an enhanced strength, at least 0.4% Mn should be present. However, more than 1.5% Mn, if present, results in seriously reduced ductility, toughness and resistance to oxidation at high temperatures. The Mn content is therefore 0.4–1.5%.

Ni: Like Mn, Ni forms austenite. To afford a uniform martensitic structure on hardening and give increased strength, at least 0.2% Ni should be used. With more than 1.0% Ni present, the increase in strength is economically unjustifiable, while lower resistance to high-temperature oxidation will result. Thus the Ni content ranges from 0.2 to 1.0%.

Cr: Cr is essential in giving high-temperature strength and resistance to high-temperature oxidation. Cr less than 10.0% makes it difficult to give resistance to high-temperature oxidation, whereas if more than 14.0% of Cr is present, delta ferrite separates out in the structure on hardening to entail reduced strength at high temperatures, hence 10.0–14.0% Cr.

Cu: The Cu content is a distinct feature of the roll materials of this invention. Cu is useful for giving enhanced high-temperature strength without sacrificing the resistance to high-temperature oxidation. When at least 0.5% Cu is used, a Cu-rich phase precipitates during tempering, giving increased resistance to temper softening and increased high-temperature strength. Above 4.0%, however, Cu renders the material susceptible to cracking during hot working. Thus the Cu content is limited to the range of 0.5–4.0%.

V: When combined with C, V forms VC and $V_4C_3$ (carbides), acting effectively in giving improved strength at high temperatures. This effect is achievable when at least 0.1% V is used. When exceeding 0.5%, V seriously impairs the ductility and toughness, resulting in lower resistance to brittle fracture. The V content is therefore in the range of 0.1–0.5%.

Nb: Nb produces the same effect as V. With at least 0.01% Nb present, NbC (carbide) separates out to afford increased high-temperature strength. Above 0.35%, Nb results in lower toughness and permits delta ferrite to easily separate out in the structure on hardening, entailing decreased strength. The Nb content is thus 0.01to 0.35%. Since further increased strength is contemplated for the second embodiment, the lower limit is 0.1%.

Al: Al is added as a killing agent. Use of at least 0.01% of Al produces finer crytals and improved toughness, but more than 0.06% Al, if used, forms increased amounts of nonmetallic inclusions (e.g. $Al_2O_3$), conversely resulting in lower toughness. The Al content therefore ranges from 0.01 to 0.06%.

Mo: Mo, which is used only for the second embodiment, forms $Mo_2C$ and $Mo_{23}C_6$ (carbides) with C and very effectively acts to give improved high-temperature strength. With at least 0.2% Mo present, stable carbides separate out to afford increased strength at high temperatures. However, use of more than 1.2% Mo fails to produce a corresponding effect, is costly and further entails impaired resistance to high-temperature oxidation, so that the Mo content is limited to the range of 0.2–1.2%. Since the addition of Mo leads to lower weldability, i.e. an increased likelihood of high-temperature cracking due to welding, as already stated, the use of Mo is to be avoided as in the first embodiment, under continuous casting conditions which weldability matters. As will become apparent from the experimental results given later, however, the use of Mo achieves improved high-temperature strength which is fully justifiable despite the attendant reduction in weldability.

B: B forms BN (nitride) with N, acting to give improved strength at high temperatures. However, if more than 0.05% of B is present, coarser particles of nitride will be formed to result in lower toughness. Thus the B content should be up to 0.05%.

Ti or Zr: These elements are needed for producing improved resistance to high-temperature oxidation and produce no adverse effect on the other properties of the roll material. To achieve the above effect, the lower limits for these elements are both 0.01%, while the upper limits are 0.2% for Ti and 0.1% for Zr. These limits are determined in view of the effect achieved and cost.

P and S: These are impurity elements which are not added positively: the lower the contents, the better. However, when not exceeding 0.03%, the contents produce hardly any adverse effect on the properties of the material. Larger amounts impair the ductility at high temperatures.

As described above, the roll materials of this invention have the distinct feature of having improved strength at high temperatures as afforded by the synergistic effects of the precipitated Cu-rich phase and precipitated carbides and nitride of V, Nb, Mo (second embodiment), B (second embodiment), etc.

Examples of experiments will be described below which were conducted for determining various properties of roll materials according to the present invention. Tables I to III show the chemical compositions of the specimens used for the experiments and the results achieved. Conventional A is a 13Cr martensitic stainless steel which is almost equivalent in chemical composition to the roll material presently used for centrifugal casting. Conventional B is a 13Cr-4Ni martensitic stainless steel prepared by overlay welding. In the amount of high-temperature oxidation, these specimens A and B are 1.21 mg/cm$^2$ and 37.1 mg/cm$^2$, respectively, which are much lower than the corresponding value of about 228 mg/cm$^2$ (not listed) for low-alloy steels conventionally used. Thus they are greatly improved in resistance to high-temperature oxidation. Comparison I, C and D are SUS 431 and SUS 420 J2, and Comparison I, E is a 12Cr-1Mo-V-Nb martensitic stainless steel. Of the specimens F to N which are alloy steels of this invention, F to N classified as Invention I are according to the first embodiment, while J to N classified as Invention II are according to the second embodiment.

Table II reveals the following. The steel B has a relatively high 0.2% proof stress of about 75 kgf/mm$^2$ at normal temperature but is the lowest in the same property at a high temperature, i.e. about 18 kgf/mm$^2$, and has the lowest resistance to high-temperature oxidation. The poor resistance of this specimen appears attributable to the fact that it contains as much as about 4% of Ni. The steel A has a 0.2% proof stress at 600° C. of about 23 kgf/mm$^2$ which is higher than that of the steel B and is also higher in resistance to high-temperature oxidation. The steel E of Comparison I has a 0.2% proof stress at 600° C. of about 35 kgf/cm$^2$ which is higher than those of the steels A and B of Conventional. The steels F to I according to the invention are about 33 kgf/mm$^2$ in this property and are comparable to the steel E of Comparison I. However, they are much superior to the other specimens of Comparison I and Conventional. The steels of Invention I, although comparable to the steel E in 0.2% proof stress at high temperature, are superior thereto in respect of weldability as will be described later, so that they are exceedingly more advantageous for use as roll materials. The steels J to N of Invention II are at least about 40 kgf/mm$^2$ in 0.2% proof stress and are superior to any other alloy steel listed. Further with respect to resistance to high-temperature oxidation, the steels F, G, J, K and L are not greatly different from the steel A having high resistance. It is especially noteworthy that the steels H, I, M and N, which contain Ti or Zr, are further improved in this resistance. Presumably this is attributable to the Ti or Zr content which stabilizes the oxide coating.

Table III shows experimental data which, when compared with Table II, reveals that the alloy steels of Invention I have outstanding weldability. The alloy steels of Comparison II have approximately the same compositions as those of Invention II and are therefore equivalent thereto in respect of 0.2% proof stress at normal temperature as well as at high temperature and resistance to high-temperature oxidation. The specimens were tested for welding hot cracks by preparing a test piece, 20 mm (t)×100 mm (w)×200 mm (1) from each specimen, forming a melt run in the vicinity of the center of the width of the piece by tungsten inert gas arc welding and measuring the total length of weld cracks developing the direction of columnar crystals. The steels F to I and O to R were continuously welded to form a weld bead 200 mm in length, while the steel E was welded to form a weld bead 15 mm in length.

A comparison between Tables II and III reveals that the alloy steels of Invention I are free from any welding hot crack and superior to the specimens of Comparison II (i.e. invention II) in weldability although inferior in 0.2% proof stress at high temperature. Furthermore, the hot cracks occurred in the steel E are 4.9 mm in total length for 15-mm-long bead. When calculated for a bead length of 200 mm, this length corresponds to about 65 mm (although this has not been actually substantiated). As compared with the alloy steels of Invention I which are free from hot cracks, the steel E is equivalent thereto in 0.2% proof stress at high temperature and in resistance to high-temperature oxidation, so that the lower weldability thereof means that the steel is correspondingly more disadvantageous.

The roll materials of Invention I and Invention II, when suitably heat-treated (hardened and tempered), exhibit absorbed energy values of at least about 4.2 kgf.m and about 3.4 kgf.m, respectively, as determined by the Charpy impact test. These values indicate that they have high brittle fracture resistance.

The roll materials of this invention can be easily prepared by the usual casting process other than hot working and also by centrifugal casting and electric slag casting. The materials can be produced further by overlay welding with use of fluxes for adding alloy elements

TABLE I

| Classification | | Chemical composition (wt. %) | | | | | | | | | | | | | |
|---|---|---|---|---|---|---|---|---|---|---|---|---|---|---|---|
| | | C | Si | Mn | Ni | Cr | Cu | V | Nb | Al | Mo | B | P | S | Ti or Zr |
| A | Conven- | 0.13 | 0.39 | 0.42 | 0.13 | 11.85 | — | — | — | — | — | — | 0.029 | 0.020 | — |
| B[1] | tional I | 0.08 | 0.16 | 0.72 | 4.28 | 13.10 | — | — | — | — | 0.08 | — | 0.021 | 0.014 | — |
| C | Compar- | 0.18 | 0.41 | 0.77 | 1.56 | 15.18 | — | — | — | — | — | — | 0.027 | 0.007 | — |
| D | ison I | 0.36 | 0.55 | 0.44 | 0.27 | 12.25 | — | — | — | — | — | — | 0.028 | 0.022 | — |
| E | | 0.15 | 0.28 | 0.35 | 0.23 | 11.77 | — | 0.21 | 0.25 | 0.012 | 0.92 | — | 0.021 | 0.015 | — |
| F | Inven- | 0.15 | 0.29 | 0.60 | 0.51 | 11.92 | 1.42 | 0.20 | 0.19 | 0.012 | — | — | 0.016 | 0.015 | — |
| G | tion I | 0.16 | 0.33 | 0.42 | 0.42 | 11.82 | 2.51 | 0.25 | 0.21 | 0.014 | — | — | 0.013 | 0.012 | — |
| H | | 0.14 | 0.28 | 0.51 | 0.68 | 11.76 | 1.52 | 0.20 | 0.19 | 0.013 | — | — | 0.015 | 0.011 | Ti: 0.48 |
| I | | 0.12 | 0.31 | 0.54 | 0.49 | 12.11 | 1.48 | 0.15 | 0.18 | 0.018 | — | — | 0.012 | 0.012 | Zr: 0.04 |
| J | Inven- | 0.15 | 0.31 | 0.42 | 0.41 | 11.86 | 1.32 | 0.22 | 0.20 | 0.015 | 0.24 | 0.003 | 0.015 | 0.012 | — |
| K | tion II | 0.16 | 0.29 | 0.51 | 0.28 | 11.92 | 2.40 | 0.21 | 0.24 | 0.011 | 0.89 | 0.004 | 0.014 | 0.013 | — |
| L | | 0.17 | 0.28 | 1.42 | 0.42 | 12.01 | 0.58 | 0.28 | 0.21 | 0.014 | 0.98 | 0.001 | 0.019 | 0.012 | — |
| M | | 0.15 | 0.35 | 0.62 | 0.32 | 11.42 | 1.34 | 0.24 | 0.35 | 0.013 | 1.10 | 0.003 | 0.021 | 0.014 | Ti: 0.14 |
| N | | 0.14 | 0.31 | 0.58 | 0.27 | 11.83 | 1.61 | 0.22 | 0.28 | 0.012 | 1.01 | 0.003 | 0.020 | 0.016 | Zr: 0.05 |

TABLE II

| Classification | | Thermal expansion coefficient 20–600° C. × $10^{-6}$/°C. | Tensile Properties[2] Normal temperature 0.2% proof stress (kgf/mm²) | Normal temperature Reduction of area (%) | 600° C. 0.2% proof stress (kgf/mm²) | 600° C. Reduction of area (%) | High-temp. oxidation[3] 800° C. × 200 h (mg/cm²) | Welding hot crack[4] Total length (mm) |
|---|---|---|---|---|---|---|---|---|
| A | Conven- | 12.33 | 56.1 | 68.1 | 23.3 | 88.1 | 1.21 | — |
| B | tional I | 12.25 | 75.4 | 53.1 | 18.1 | 76.2 | 37.1 | — |
| C | Compar- | 12.60 | 69.0 | 50.7 | 26.1 | 91.8 | 0.97 | — |
| D | ison I | 12.50 | 70.9 | 50.3 | 24.5 | 83.0 | 0.98 | — |
| E | | 12.70 | 72.1 | 57.0 | 35.4 | 81.2 | 1.65 | 4.9[5] |
| F | Inven- | 12.32 | 76.2 | 57.1 | 33.1 | 86.1 | 1.61 | 0 |
| G | tion I | 12.35 | 78.1 | 56.2 | 34.8 | 84.2 | 1.72 | 0 |
| H | | 12.32 | 76.2 | 58.2 | 32.9 | 87.5 | 0.78 | 0 |
| I | | 12.34 | 75.9 | 55.4 | 33.1 | 85.1 | 0.45 | 0 |
| J | Inven- | 12.30 | 80.2 | 56.9 | 39.2 | 83.3 | 1.62 | — |
| K | tion II | 12.45 | 83.7 | 54.7 | 42.4 | 82.3 | 1.89 | — |
| L | | 12.30 | 82.1 | 50.1 | 40.1 | 80.0 | 2.51 | — |
| M | | 12.20 | 80.0 | 54.7 | 41.0 | 83.3 | 0.61 | — |
| N | | 12.59 | 82.2 | 55.1 | 41.5 | 82.3 | 0.35 | — |

TABLE III

| Classification | | Chemical composition (wt. %) | | | | | | | | | | | | | Welding hot crack[4] Total length (mm) |
|---|---|---|---|---|---|---|---|---|---|---|---|---|---|---|---|
| | | C | Si | Mn | Ni | Cr | Cu | V | Nb | Al | Mo | B | P | S | |
| O | Compar- | 0.15 | 0.31 | 0.42 | 0.41 | 11.86 | 1.32 | 0.22 | 0.20 | 0.015 | 0.24 | 0.03 | 0.015 | 0.012 | 15 |
| P | ison II | 0.16 | 0.33 | 0.62 | 0.51 | 11.78 | 1.25 | 0.21 | 0.21 | 0.011 | 0.51 | — | 0.016 | 0.011 | 29 |
| Q | | 0.14 | 0.28 | 0.53 | 0.42 | 11.82 | 1.34 | 0.24 | 0.21 | 0.015 | 1.10 | — | 0.016 | 0.013 | 42 |

TABLE III-continued

| Classification | Chemical composition (wt. %) | | | | | | | | | | | | | Welding hot crack[4] Total length (mm) |
|---|---|---|---|---|---|---|---|---|---|---|---|---|---|---|
| | C | Si | Mn | Ni | Cr | Cu | V | Nb | Al | Mo | B | P | S | |
| R | 0.16 | 0.29 | 0.51 | 0.28 | 11.92 | 2.40 | 0.21 | 0.24 | 0.011 | 0.89 | 0.011 | 0.014 | 0.013 | 21 |

[1]Prepared by overlay welding.
[2]With use of a flanged test piece. (10 mm in diam., 50 mm in length)
[3]Test conditions
Test piece: 12 mm × 20 mm.
Heating: Continuous heating in atmosphere.
Temperature: 800° C.
Time: 200 hours.
[4]Test conditions
Preheating: 150-200° C.
Heat input: 2500 J/cm.
Welding speed: 15 cm-min.
Bead length: 200 mm.
[5]15 mm in bead length.

What is claimed is:

1. A roll material comprising, in proportions by weight, 0.04–0.20% C, 0.2–0.8% Si, 0.4–1.5% Mn, 0.2–1.0% Ni, 10.0–14.0% Cr, 0.5–4% Cu, 0.1–0.5% V, 0.01–0.35% Nb, 0.01–0.06% Al, P and S each in a reduced amount of up to 0.03% as impurity elements, and the balance Fe.

2. A roll material as defined in claim 1 which further comprises 0.01–0.2% by weight of Ti.

3. A roll material comprising, in proportions by weight, 0.04–0.20% C, 0.2–0.8% Si, 0.4–1.5% Mn, 0.2–1.0% Ni, 10.0–14.0% Cr, 0.5–4% Cu, 0.1–0.5% V, 0.1–0.35% Nb, 0.01–0.06% Al, 0.2–1.2% Mo, up to 0.05% B, P and S each in a reduced amount of up to 0.03% as impurity elements, and the balance Fe.

4. A roll material as defined in claim 3 which further comprises 0.01–0.2% by weight of Ti.

5. A roll material as defined in claim 1 which further comprises 0.01–0.1% by weight of Zr.

6. A roll material as defined in claim 3 which further comprises 0.01–0.1% by weight of Zr.

7. A roll material for continuous casting equipment and having the combined properties of resistance to high-temperature oxidation, resistance to thermal fatigue cracking, flexural strength, brittle fracture resistance and good weldability, said material comprising in proportions by weight, 0.04–0.20% C, 0.2–0.8% Si, 0.4–1.5% Mn, 0.2–1.0% Ni, 10.0–14.0% Cr, 0.5–4% Cu, 0.1–0.5% V, 0.01–0.35% Nb, 0.01–0.06% Al, P and S each in a reduced amount of up to 0.03% as impurity elements, and the balance Fe.

8. A roll material as defined in claim 7 which further comprises 0.01–0.2% by weight of Ti.

9. A roll material as defined in claim 7 which further comprises 0.01–0.1% by weight of Zr.

10. A roll material for continuous casting equipment and having the combined properties of resistance to high-temperature oxidation, resistance to thermal fatigue cracking, flexural strength, and brittle fracture resistance, said material comprising in proportions by weight, 0.04–0.20% C, 0.2–0.8% Si, 0.4–1.5% Mn, 0.2–1.0% Ni, 10.0–14.0% Cr, 0.5–4% Cu, 0.1–0.5% V, 0.1–0.35% Nb, 0.01–0.06% Al, 0.2–1.2% Mo, up to 0.05% B, P and S each in a reduced amount of up to 0.03% as impurity elements, and the balance Fe.

11. A roll material as defined in claim 10 which further comprises 0.01–0.2% by weight of Ti.

12. A roll material as defined in claim 10 which further comprises 0.01–0.1% by weight of Zr.

* * * * *